US012351417B2

(12) United States Patent
Miyata

(10) Patent No.: US 12,351,417 B2
(45) Date of Patent: Jul. 8, 2025

(54) SHEET PROCESSING DEVICE

(71) Applicant: TOSHIBA TEC KABUSHIKI KAISHA, Tokyo (JP)

(72) Inventor: Kazuki Miyata, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 1 day.

(21) Appl. No.: 18/429,485

(22) Filed: Feb. 1, 2024

(65) Prior Publication Data

US 2024/0391728 A1 Nov. 28, 2024

(30) Foreign Application Priority Data

May 22, 2023 (JP) ..... 2023-083969

(51) Int. Cl.
*B65H 45/18* (2006.01)

(52) U.S. Cl.
CPC ... *B65H 45/18* (2013.01); *B65H 2301/51232* (2013.01); *B65H 2701/13212* (2013.01)

(58) Field of Classification Search
CPC ..... B65H 45/18; B65H 45/30; B65H 2701/13212; B65H 2801/27; G03G 15/6582; G03G 2215/00877
See application file for complete search history.

(56) References Cited

U.S. PATENT DOCUMENTS

| | | | | |
|---|---|---|---|---|
| 9,815,656 | B2 * | 11/2017 | Awano | B65H 45/12 |
| 2012/0190526 | A1 | 7/2012 | Terao | |
| 2012/0243962 | A1 | 9/2012 | Kato et al. | |
| 2013/0049278 | A1 * | 2/2013 | Tsuchiya | B65H 31/38 270/45 |
| 2014/0206519 | A1 | 7/2014 | Hoshino et al. | |
| 2015/0045197 | A1 * | 2/2015 | Sugiyama | B31F 1/00 493/407 |
| 2016/0154363 | A1 | 6/2016 | Osada | |
| 2016/0282791 | A1 * | 9/2016 | Awano | G03G 15/6538 |
| 2024/0294352 | A1 * | 9/2024 | Yamamoto | B65H 45/30 |

* cited by examiner

*Primary Examiner* — Jennifer Bahls
(74) *Attorney, Agent, or Firm* — Amin Turocy & Watson, LLP

(57) ABSTRACT

A sheet processing device includes a folding unit, a first roller, and a pair of second rollers. The folding unit folds a sheet and forms a fold in the sheet. The pair of second rollers moves in a fold direction and additionally folds the fold. The first roller includes a first large diameter section and a first small diameter section. Each of the pair of second rollers includes a second large diameter section and a second small diameter section. The second large diameter section holds the sheet between the second large diameter section and the first small diameter section. The second small diameter section holds the sheet between the second small diameter section and the first large diameter section.

20 Claims, 10 Drawing Sheets

SHEET PROCESSING DEVICE

CROSS-REFERENCE TO RELATED APPLICATION

This application is based upon and claims the benefit of priority from Japanese Patent Application No. 2023-083969, filed on May 22, 2023, the entire contents of which are incorporated herein by reference.

FIELD

Embodiments described herein relate generally to a sheet processing device and an image forming apparatus.

BACKGROUND

A sheet processing device includes a folding unit that folds a sheet to form a fold in the sheet and an additional folding unit that additionally folds the fold of the sheet. There is a demand for a sheet processing device that can reinforce additional folding.

DETAILED DESCRIPTION

Figure 1:
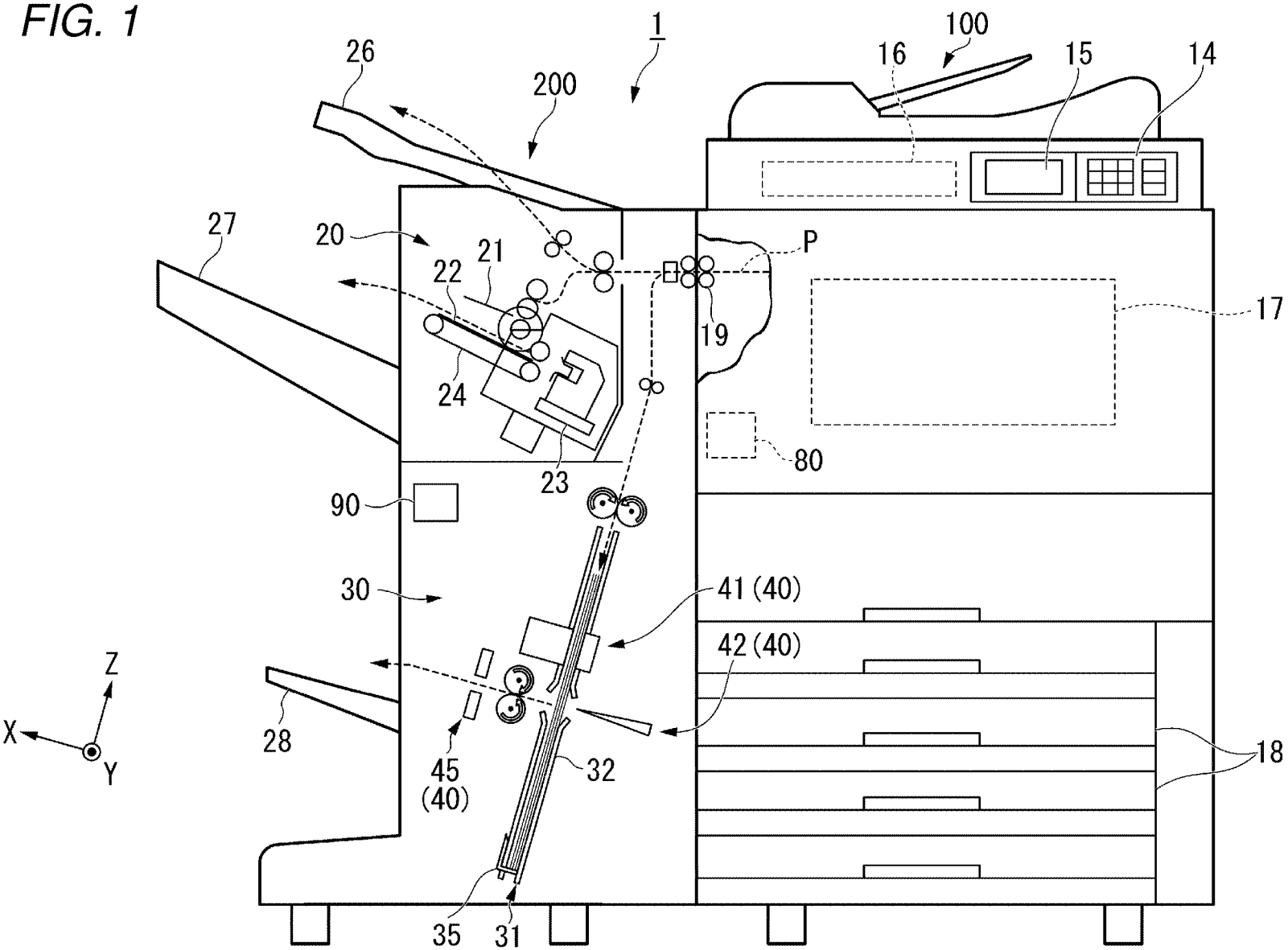
FIG. 1 is a schematic configuration diagram of an image forming apparatus.

An aspect of embodiments is to provide a sheet processing device that can reinforce additional folding.

A sheet processing device according to a first aspect includes a folding unit, a first roller, and a pair of second rollers. The folding unit folds a sheet and forms a fold in the sheet. The first roller is provided rotatably around an axis extending in a conveying direction orthogonal to a fold direction. The first roller moves in the fold direction. The pair of second rollers is provided rotatably around an axis extending in the conveying direction. The pair of second rollers moves in the fold direction while holding the sheet between the pair of second rollers and the first roller and additionally folds the fold. The pair of second rollers are disposed side by side in the fold direction. The first roller includes a first large diameter section and a first small diameter section. The first large diameter section is present in a first position in the conveying direction. The first small diameter section is present in a second position in the conveying direction. The first small diameter section is smaller in diameter than the first large diameter section. Each of the pair of second rollers includes a second large diameter section and a second small diameter section. The second large diameter section is present in the second position. The second large diameter section holds the sheet between the second large diameter section and the first small diameter section. The second small diameter section is present in the first position. The second small diameter section holds the sheet between the second small diameter section and the first large diameter section. The second small diameter section is smaller in diameter than the second large diameter section.

A sheet processing device according to a second aspect is the sheet processing device according to the first aspect, wherein an outer diameter in a third position in the conveying direction of the first roller may be larger than an interval in the third position between the pair of second rollers.

A sheet processing device according to a third aspect is the sheet processing device according to the first aspect or the second aspect, wherein an outer diameter of the first large diameter section may be larger than an interval in the second position between the second rollers.

A sheet processing device according to a fourth aspect is the sheet processing device according to any one aspect of the first aspect to the third aspect, wherein a rotation axis of the first roller may be present in an intermediate position of rotation axes of the pair of second rollers in the fold direction.

A sheet processing device according to a fifth aspect is the sheet processing device according to any one aspect of the first aspect to the third aspect, wherein a rotation axis of the first roller may be present in a position shifted in the fold direction with respect to an intermediate position of rotation axes of the pair of second rollers in the fold direction.

A sheet processing device in an embodiment is explained below with reference to the drawings. Note that, in the following explanation, components having the same or similar functions are denoted by the same reference numerals and signs. Redundant explanation of the components is sometimes omitted.

FIG. 1 is a schematic configuration diagram of an image forming apparatus 1. For example, the image forming apparatus 1 is disposed in a workplace. The image forming apparatus 1 includes an image forming apparatus main body 100 and a sheet processing device 200. The image forming apparatus main body 100 and the sheet processing device 200 are disposed adjacent to each other.

The image forming apparatus main body 100 is explained.

The image forming apparatus main body 100 forms an image on a sheet P (a recording medium) using a recording agent. The sheet P is, for example, plain paper or label paper. A specific example of the recording agent is toner. The toner is toner used as a decolorable recording agent or toner used as a non-decolorable recording agent.

For example, the image forming apparatus main body 100 is a multifunction peripheral. As illustrated in FIG. 1, the image forming apparatus main body 100 includes a display section 15, an operation section 14, an image reading section 16, a printer section 17, a sheet storing section 18, a paper discharge roller 19, and a first control section 80.

The display section 15 is an image display device such as a liquid crystal display or an organic EL (Electro Luminescence) display. The display section 15 displays various kinds of information concerning the image forming apparatus main body 100 and the sheet processing device 200.

The operation section 14 includes a plurality of buttons. The operation section 14 receives operation of a user. The operation section 14 outputs a signal corresponding to the operation performed by the user to the first control section 80 of the image forming apparatus main body 100. The display section 15 and the operation section 14 may be configured as an integral touch panel.

The image reading section 16 reads image information of a reading target based on brightness and darkness of light. The image reading section 16 outputs the read image information to the printer section 17.

The sheet storing section 18 stores sheets P used for image formation. The sheet storing section 18 supplies a stored sheet P to the printer section 17.

The printer section 17 forms an image on the sheet P based on the image information generated by the image reading section 16 or image information received via a communication path. The printer section 17 includes an image forming section, a transfer section, and a fixing device. The image forming section forms an electrostatic latent image on a photoconductive drum based on the image information. The image forming section deposits toner on the electrostatic latent image and forms a visible image. The transfer section transfers the visible image onto the sheet P. The fixing device heats and pressurizes the toner and fixes the visible image on the sheet P.

The paper discharge roller 19 is disposed near a paper discharge port of the image forming apparatus main body 100. The paper discharge roller 19 feeds the sheet P, on which the image is formed, to the sheet processing device 200.

Figure 2:
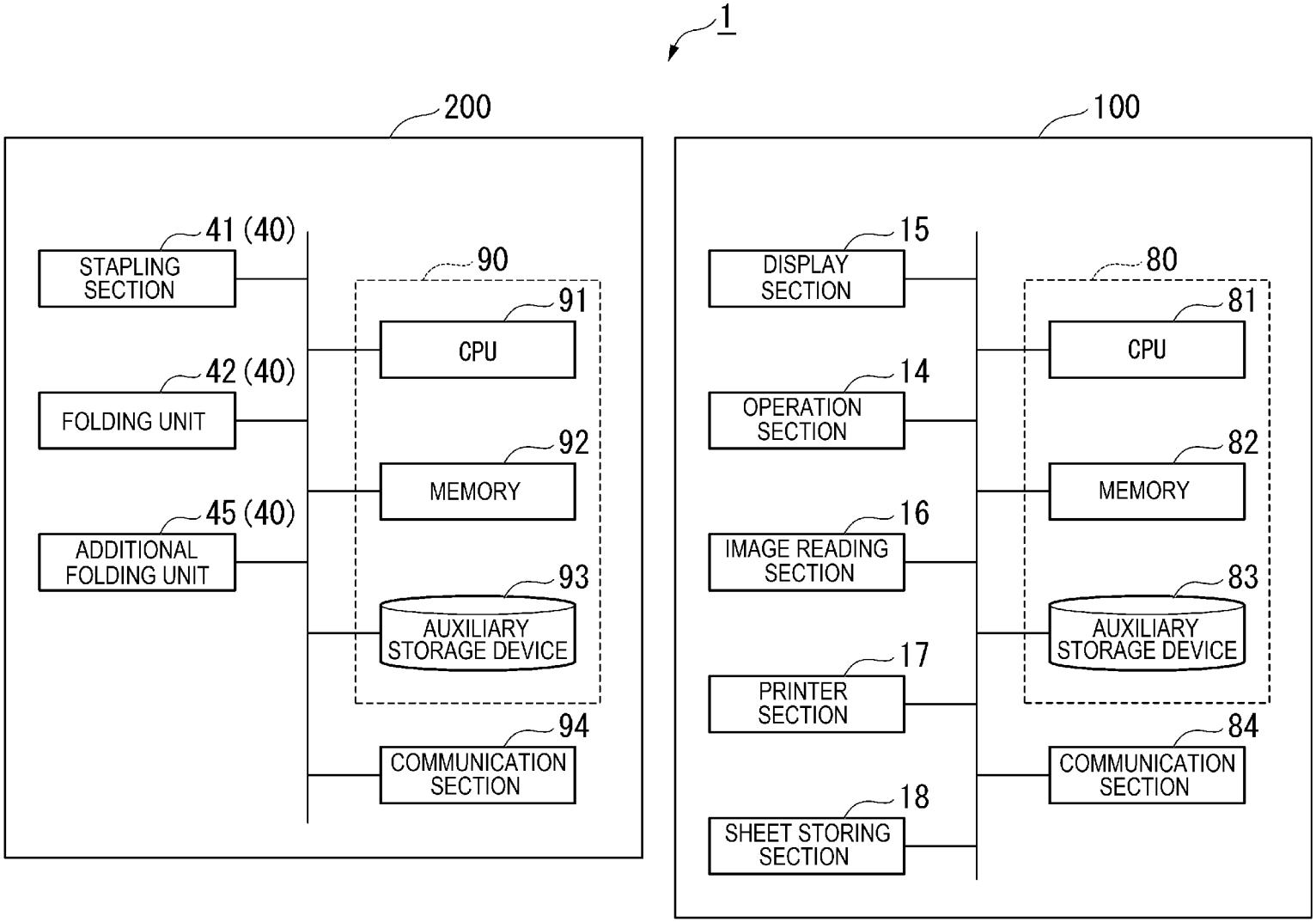
FIG. 2 is a block diagram illustrating a functional configuration example of the image forming apparatus.

FIG. 2 is a block diagram illustrating a functional configuration example of the image forming apparatus 1. As illustrated in FIG. 2, the image forming apparatus main body 100 includes a CPU (Central Processing Section) 81, a memory 82, an auxiliary storage device 83, and the like connected by a bus and executes a program. By executing the program, the image forming apparatus main body 100 functions as a device including the display section 15, the operation section 14, the image reading section 16, the printer section 17, the sheet storing section 18, and a communication section 84.

The CPU 81 executes a program stored in the memory 82 and the auxiliary storage device 83 to thereby function as the first control section 80. The first control section 80 controls operations of the sections of the image forming apparatus main body 100 and the sheet processing device 200.

The auxiliary storage device 83 is configured using a storage device such as a magnetic hard disk device or a semiconductor storage device. The auxiliary storage device 83 stores information.

The communication section 84 includes a communication interface for connecting the image forming apparatus main body 100 to an external device. The communication section 84 communicates with the external device via the communication interface.

The sheet processing device 200 is explained.

As illustrated in FIG. 1, the sheet processing device 200 applies post-processing to the sheet P on which an image is formed. For example, the post-processing is stapling or saddle folding. The sheet processing device 200 includes a stapling mechanism 20, a saddle folding mechanism 30, and a second control section (a control section) 90.

The stapling mechanism 20 includes a standby tray 21, a processing tray 22, and a stapler 23. The stapler 23 applies the stapling to a peripheral edge portion of a plurality of sheets P. The plurality of sheets P are hereinafter referred to sheet bundle. The stapled sheets P are conveyed by a conveyor belt 24 and discharged to a movable tray 27.

The sheet processing device 200 includes the movable tray 27, an upper tray 26, and a lower tray 28. The stapled sheets P are discharged to the movable tray 27. The sheets P not stapled are discharged to the upper tray 26. The lower tray 28 is present in a lower part of the sheet processing device 200. The sheets P processed by the saddle folding mechanism 30 are discharged to the lower tray 28.

First Embodiment

Figure 3:
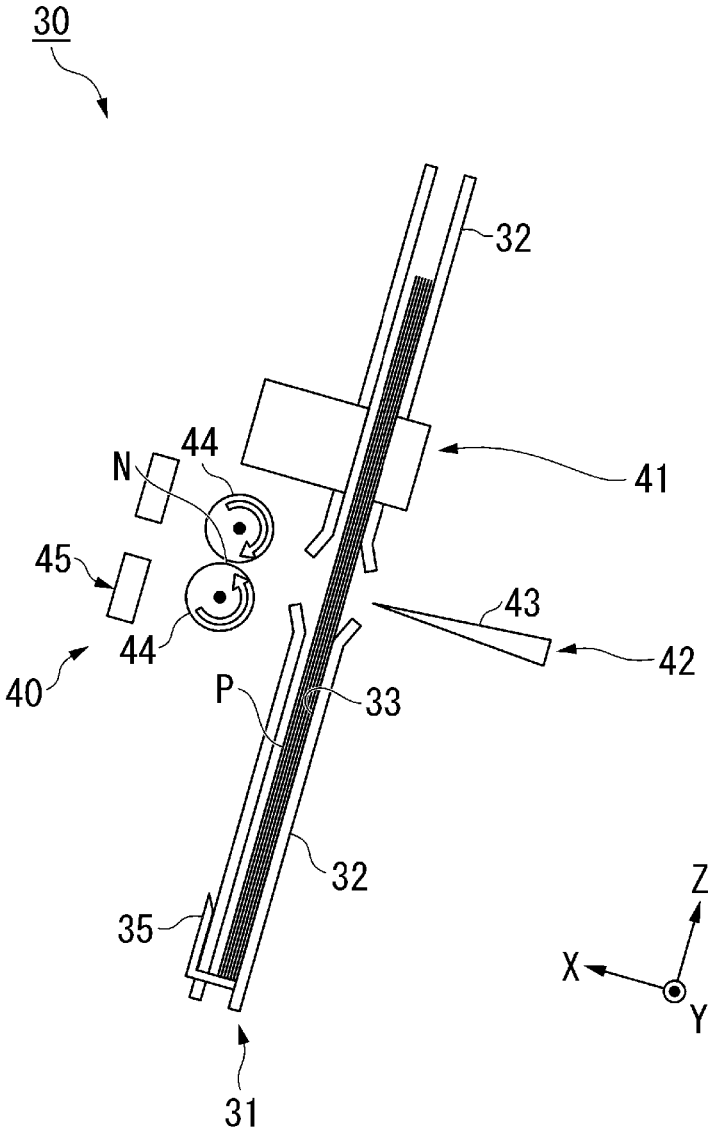
FIG. 3 is a front view illustrating a schematic configuration of a saddle folding mechanism in a sheet processing device in a first embodiment.

FIG. 3 is a front view illustrating a schematic configuration of the saddle folding mechanism 30 in the sheet processing device 200 in the first embodiment. As illustrated in FIG. 3, the saddle folding mechanism 30 includes a sheet supporting section 31 and a post-processing section 40. The post-processing section 40 includes a stapling section 41, a folding unit 42, and an additional folding unit 45.

The sheet supporting section 31 is provided at the downstream end in a conveying direction of the sheets P in a conveyance path of the sheets P. The sheets P are stacked on the sheet supporting section 31. The sheet supporting section 31 includes a bed 32 and a stacker 35. The bed 32 includes a paper stacking surface 33 that supports the surface of the sheets P.

As a local coordinate system of the saddle folding mechanism 30, an X direction, a Y direction, and a Z direction of an orthogonal coordinate system are defined as follows. The X direction is the normal direction of the paper stacking surface 33 of the bed 32. A +X direction is a direction in which the sheets P are stacked on the bed 32. The +X direction is a direction further inclined upward than the horizontal direction. The Z direction is a conveying direction of the sheets P in the saddle folding mechanism 30. A −Z direction is a direction in which the sheets P are conveyed to the sheet supporting section 31 through the conveyance path. The −Z direction is a direction further inclined downward than the horizontal direction. The Y direction is the horizontal direction.

The bed 32 has a substantially plate shape and is capable of stacking the sheets P on the paper stacking surface 33 facing the +X direction. The bed 32 is present on both sides in the Z direction across the folding unit 42. The sheets P placed on the paper stacking surface 33 are supported by the stacker 35. The stacker 35 restricts the leading end in the −Z direction of the sheets P conveyed to the sheet supporting section 31. The stacker 35 is movable in the Z direction. For example, the stacker 35 is driven by a moving mechanism disposed in the −X direction of the bed 32.

The stapling section 41 processes the sheets P in a position further in the +Z direction than a position where the sheets P are supported by the stacker 35. The stapling section 41 is present in the +Z direction of the folding unit 42. The stapling section 41 applies stapling to a predetermined position of the sheets P. For example, the predetermined position of the sheets P is the center in the Z direction of the sheets P.

The folding unit 42 processes the sheets P in a position further in the +Z direction than the position where the sheets P are supported by the stacker 35. The folding unit 42 folds the center in the Z direction of the sheets P and forms a fold F in the sheets P. The folding unit 42 includes a pair of folding rollers 44 and a blade 43.

The pair of folding rollers 44 is present in the +X direction of the bed 32. The pair of folding rollers 44 is disposed side by side in the Z direction. Rotation axes of the pair of folding rollers 44 extend in the Y direction. The pair of folding rollers 44 is driving rollers. However, one of the pair of folding rollers 44 may be a driven roller. The pair of folding rollers 44 is each displaceable in the Z direction. The pair of folding rollers 44 is displaced in the Z direction to be enabled to approach and separate from each other. The pair of folding rollers 44 is displaced in the Z direction in association with each other. The pair of folding rollers 44 comes into contact with each other to form a nip N.

The blade 43 has a tabular shape and is parallel to an XY plane. The blade 43 has a shape tapered in the +X direction. The blade 43 is capable of moving in the X direction passing the bed 32. The blade 43 pushes the sheets P into the nip N to form a fold extending in the Y direction in the sheets P in cooperation with the pair of folding rollers 44.

The additional folding unit 45 is present in the +X direction of the pair of folding rollers 44. The additional folding unit 45 additionally folds the fold F of the sheets P.

For example, the saddle folding mechanism 30 can execute bookbinding processing on a sheet bundle. In the bookbinding processing, the saddle folding mechanism 30 applies stapling and saddle folding to the sheet bundle stacked on the sheet supporting section 31.

In the bookbinding processing, first, the saddle folding mechanism 30 applies the stapling to the sheet bundle. The stacker 35 moves the sheet bundle in the +Z direction and aligns the center in the Z direction of the sheet bundle with the position of the stapling section 41. The stapling section 41 applies the stapling to the sheet bundle.

Subsequently, the saddle folding mechanism 30 applies the saddle folding to the stapled sheet bundle. The stacker 35 moves the sheet bundle in the −Z direction and aligns the center in the Z direction of the sheet bundle with the position of the blade 43. The blade 43 moves in the +X direction and pushes the center of the sheet bundle into between the pair of folding rollers 44. The sheet bundle is saddle-folded in the center in the Z direction. The fold F extending in the Y direction is formed on the end side in the +X direction of the saddle-folded sheet bundle. The additional folding unit 45 additionally folds the fold F of the sheet bundle. Consequently, the bookbinding processing for the sheet bundle is completed. The bound sheet bundle is discharged to the lower tray 28.

Instead of bookbinding processing, the saddle folding mechanism 30 can apply the saddle folding to one or more sheets P stacked on the sheet supporting section 31 without applying the stapling to the sheets P. The one or more sheets P are one sheet P or a sheet bundle. In this case, the stacker 35 directly conveys the one or more sheets P from a stack position to the folding unit 42. Thereafter, as in the saddle folding in the bookbinding processing, the stacker 35 collectively forms a fold in the one or more sheets P. The sheets P, in which the fold is formed, is discharged to the lower tray 28.

As illustrated in FIG. 2, the sheet processing device 200 includes a CPU (Central Processing Section) 91, a memory 92, an auxiliary storage device 93, and the like connected by a bus. The sheet processing device 200 executes a program. The sheet processing device 200 executes the program to thereby function as a device including the stapling mechanism 20, the saddle folding mechanism 30, and a communication section 94.

The CPU 91 executes a program stored in the memory 92 and the auxiliary storage device 93 to thereby function as the second control section 90. The second control section 90 controls operations of the sections of the sheet processing device 200.

The auxiliary storage device 93 is configured using a storage device such as a magnetic hard disk device or a semiconductor storage device. The auxiliary storage device 93 stores information.

The communication section 94 includes a communication interface for connecting the sheet processing device 200 to an external device. The communication section 94 communicates with the external device via the communication interface.

The additional folding unit 45 is explained.

Figure 4:
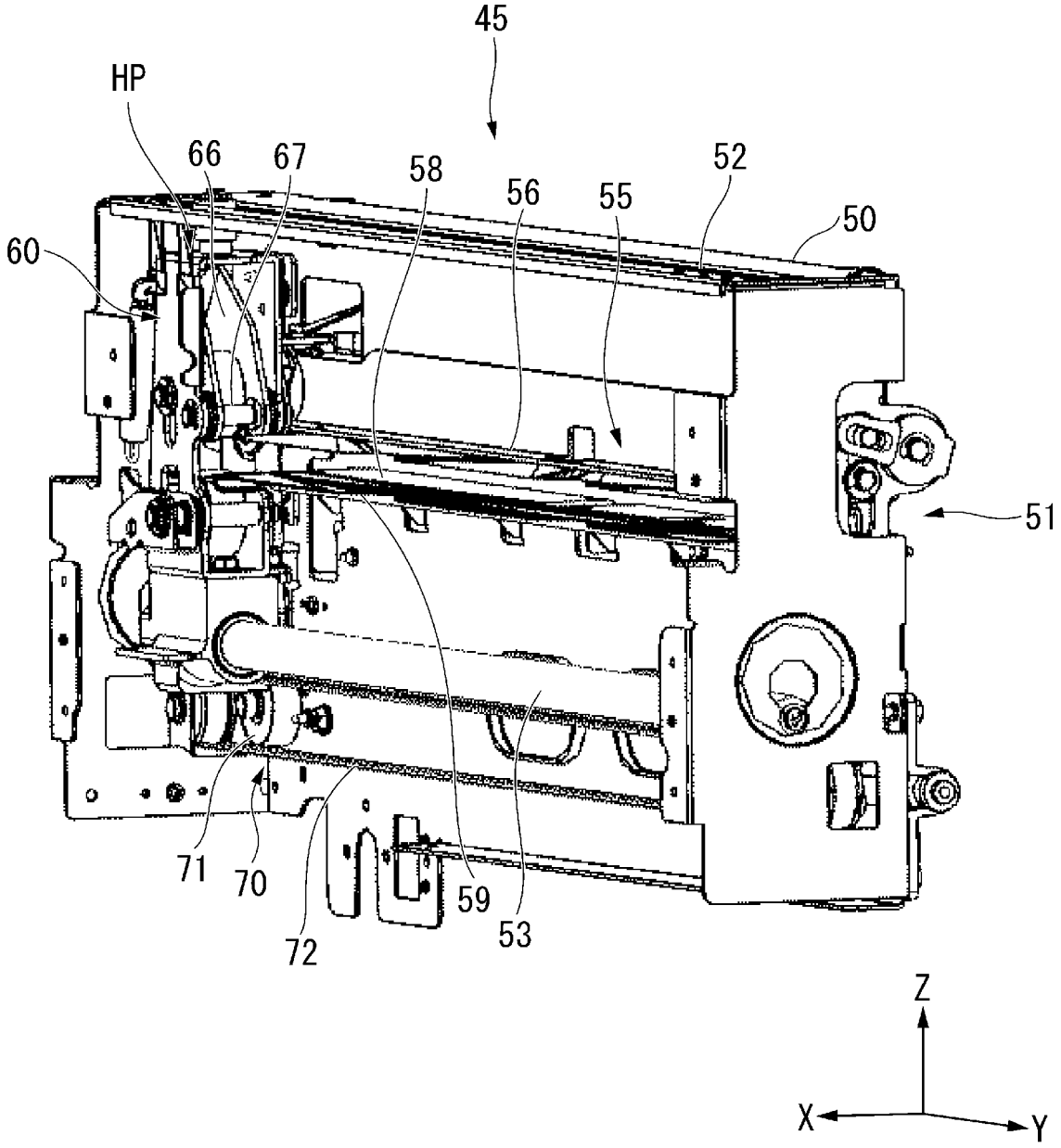
FIG. 4 is a perspective view of an additional folding unit in the sheet processing device.
Figure 5:
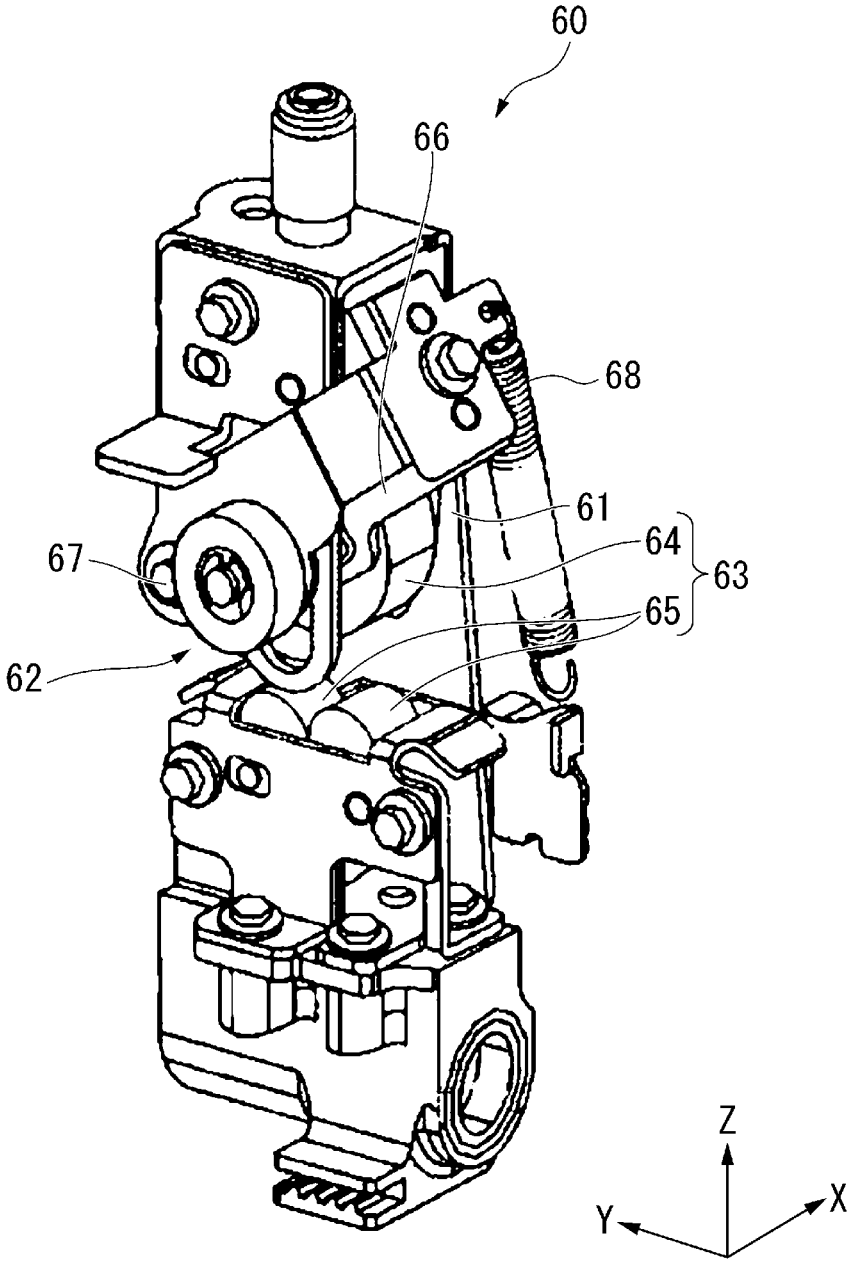
FIG. 5 is a front sectional view illustrating a schematic configuration of a folding unit and the additional folding unit in the sheet processing device.

FIG. 4 is a perspective view of the additional folding unit 45 in the sheet processing device 200 in the first embodiment. FIG. 5 is a front sectional view illustrating a schematic configuration of the folding unit 42 and the additional folding unit 45 in the sheet processing device 200 in the first embodiment. Note that, in FIG. 5, an additional folding roller 63 is simplified and illustrated. As illustrated in FIGS. 4 and 5, the additional folding unit 45 includes a frame 50, a supporting section 55, a roller unit 60, and a driving section 70. A sheet conveying direction in the additional folding unit 45 is the X direction orthogonal to the Y direction, which is a fold direction. In the additional folding unit 45, the sheets P are conveyed in the +X direction from the folding unit 42 on the upstream side.

The frame 50 covers the additional folding unit 45 in the −X direction, the +Z direction, the +Y direction, and the −Y direction. The frame 50 includes a main plate in the −X direction. The main plate includes a slit 51 extending in the Y direction. The slit 51 allows entry of the sheets P saddle-folded by the folding unit 42. As illustrated in FIG. 4, the frame 50 includes a top plate in the +Z direction. The top plate includes a guide hole 52 extending in the Y direction. The frame 50 includes a pair of side plates in the +Y direction and the −Y direction. The pair of side plates supports both end portions of a guide bar 53 extending in the Y direction. The guide hole 52 and the guide bar 53 guide movement in the Y direction of the roller unit 60.

As illustrated in FIG. 5, the supporting section 55 includes a first supporting plate 56, a second supporting plate 57, a first film 58, and a second film 59. The first supporting plate 56 and the second supporting plate 57 are parallel to the XY plane.

The first supporting plate 56 is present at the end portion in the +Z direction of the slit 51. The first supporting plate 56 is movable in the Z direction. The first supporting plate 56 supports the sheets P from the +Z direction.

The second supporting plate 57 is present in the −Z direction of the first supporting plate 56. The second supporting plate 57 is fixed to the frame 50. The second supporting plate 57 presses the sheets P from the −Z direction to the +Z direction.

The first film 58 and the second film 59 are formed in a film shape by a resin material or the like and have flexibility. The first film 58 and the second film 59 extend in the Y direction.

The first film 58 is fixed to the end portion in the +X direction of the first supporting plate 56. The first film 58 projects in the +X direction from the first supporting plate 56. The first film 58 is movable in the Z direction together with the first supporting plate 56. The first film 58 covers the fold F of the sheets P from the +Z direction.

The second film 59 is fixed to the end portion in the +X direction of the second supporting plate 57. The second film 59 projects in the +X direction from the second supporting plate 57. The second film 59 covers the fold F of the sheets P from the −Z direction.

Figure 6:
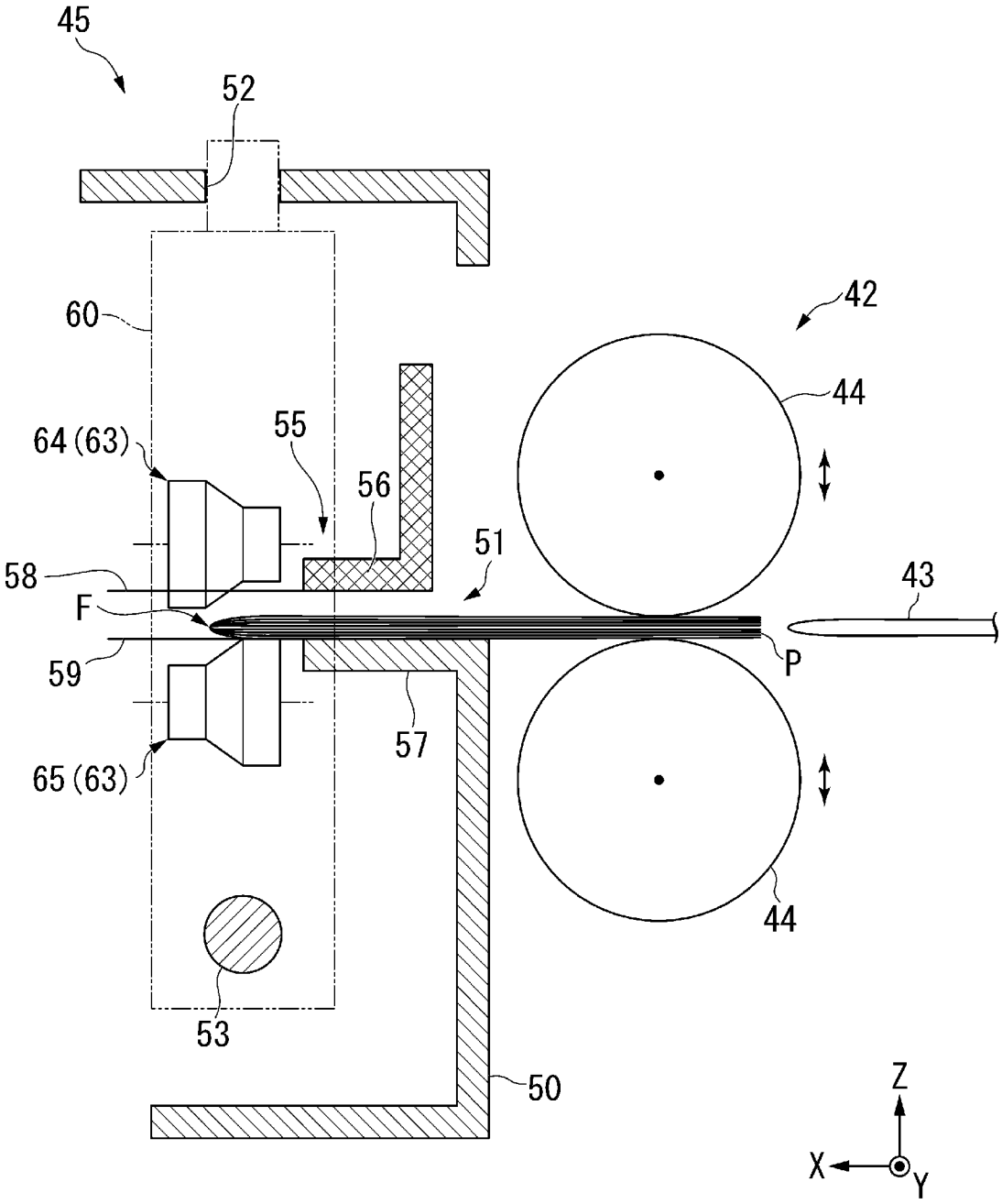
FIG. 6 is a perspective view of a roller unit in the sheet processing device.

FIG. 6 is a perspective view of the roller unit 60 in the sheet processing device 200 in the first embodiment. As illustrated in FIG. 6, the roller unit 60 includes a roller frame 61 and an additional folding roller 63.

The roller frame 61 is formed in a substantially C shape if viewed in the Y direction and includes an opening 62 in the −X direction. Interference between the sheets P entering the additional folding unit 45 and the roller unit 60 is avoided by the opening 62.

The additional folding roller 63 includes a first roller 64 and a pair of second rollers 65. Rotation axes of the first roller 64 and the second rollers 65 each extend in the X direction.

The first roller 64 is disposed in the +Z direction of the opening 62 and on the inner side of the roller frame 61. The first roller 64 is supported by an arm member 66 in a rotatable state. The arm member 66 is supported by the roller frame 61 in a state in which the arm member 66 is capable or turning around a turning shaft 67. A coil spring 68 is attached to the arm member 66.

The pair of second rollers 65 is disposed in the −Z direction of the opening 62 and on the inner side of the roller frame 61. The pair of second rollers 65 is rotatably supported by the roller frame 61.

Figure 7:
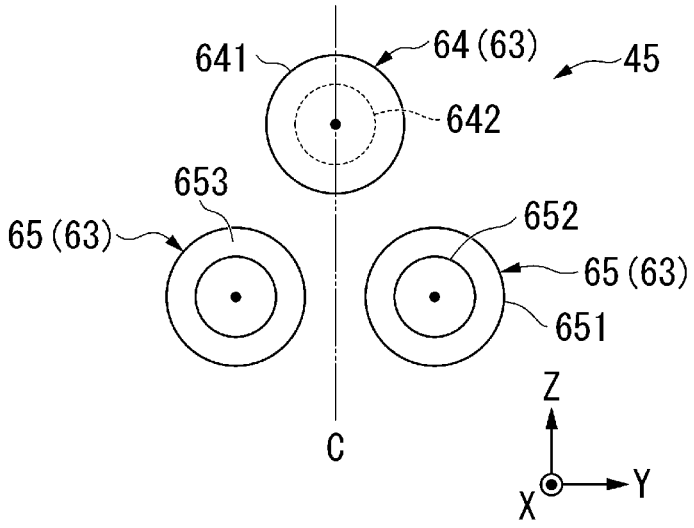
FIG. 7 is a side view illustrating a first roller and a pair of second rollers in the first embodiment.

FIG. 7 is a side view illustrating the first roller 64 and the pair of second rollers 65 in the first embodiment. As illustrated in FIG. 7, the pair of second rollers 65 is disposed side by side in the Y direction such that the rotation axes thereof overlap if viewed in the Y direction. The pair of second rollers 65 is disposed at an interval in the Y direction. The rotation axis of the first roller 64 is present between the rotation axes of the pair of second rollers 65 in the Y direction. The rotation axis of the first roller 64 is present in an intermediate position C of the rotation axes of the pair of second rollers 65 in the Y direction.

Figure 8:
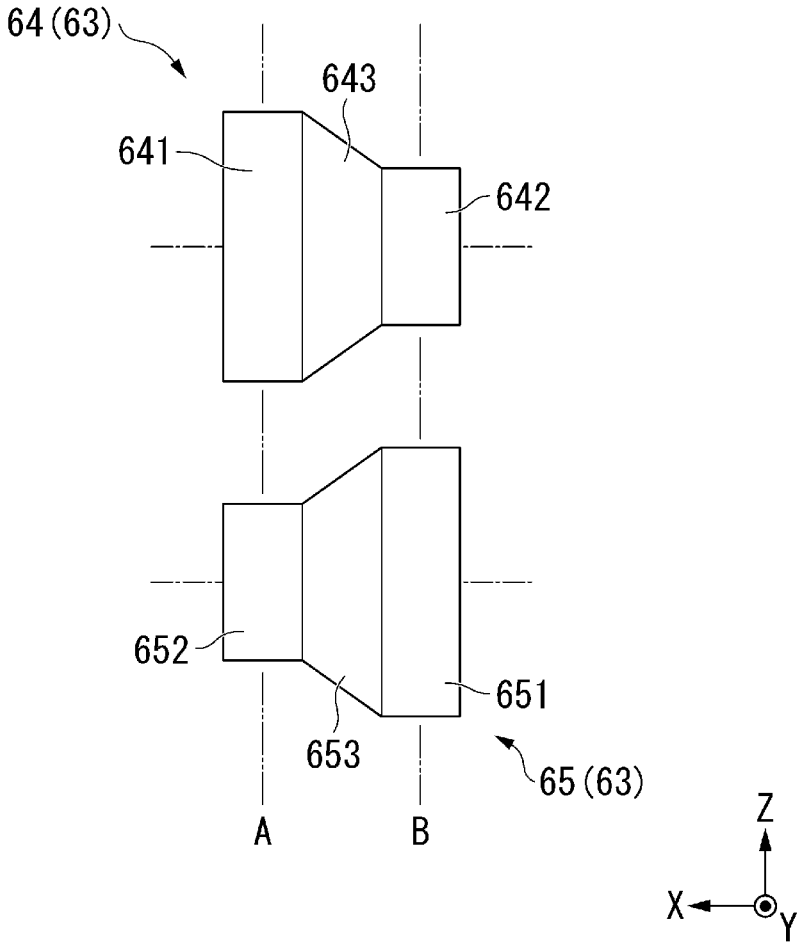
FIG. 8 is a front view illustrating the first roller and the second roller.

FIG. 8 is a front view illustrating the first roller 64 and the second roller 65 in the first embodiment. As illustrated in FIG. 8, the first roller 64 includes a first large diameter section 641 present in a first position A in the X direction, a first small diameter section 642 present in a second position B in the X direction, and a first taper section 643 located between the first large diameter section 641 and the first small diameter section 642. The second position B is a position different from the first position A and is present further in the −X direction than the first position A. Note that the first position A and the second position B illustrated in FIG. 8 are respectively examples.

The first large diameter section 641 extends in the X direction at a first outer diameter and has an outer circumferential surface capable of coming into contact with the sheets P. The first small diameter section 642 is present further in the −X direction than the first large diameter section 641. The first small diameter section 642 is located at an interval in the X direction with respect to the first large diameter section 641. The first small diameter section 642 is smaller in diameter than the second large diameter section 651. The first small diameter section 642 extends in the X direction at a second outer diameter and has an outer circumferential surface capable of coming into contact with the sheets P. In an illustrated example, the sizes in the X direction of the first large diameter section 641 and the first small diameter section 642 coincide with each other. The first taper section 643 is formed in a truncated cone shape. The outer diameter of the first taper section 643 gradually decreases toward the first small diameter section 642 side in the X direction. The first taper section 643 has an outer circumferential surface connected to the outer circumferential surfaces of the first large diameter section 641 and the first small diameter section 642.

The pair of second rollers 65 is formed in the same shape and the same size each other. Each of the second rollers 65 includes a second large diameter section 651 present in the second position B in the X direction, a second small diameter section 652 present in the first position A in the X direction, and a second taper section 653 located between the second large diameter section 651 and the second small diameter section 652.

The second large diameter section 651 extends in the X direction at a third outer dimeter and has an outer circumferential surface capable of coming into contact with the sheets P. In this embodiment, the third outer diameter is equal to the first outer diameter. A forming range in the X direction of the second large diameter section 651 coincides with a forming range in the X direction of the first small diameter section 642. The second small diameter section 652 is present further in the +X direction than the second large diameter section 651. The second small diameter section 652 is located at an interval in the X direction with respect to the second large diameter section 651. The second small diameter section 652 is smaller in diameter than the first large diameter section 641. The first small diameter section 642 extends in the X direction at a fourth outer diameter and has an outer circumferential surface capable of coming into contact with the sheets P. In this embodiment, the fourth outer diameter is equal to the second outer diameter. A forming range in the X direction of the second small diameter section 652 coincides with a forming range in the X direction of the first large diameter section 641. The difference between the third outer diameter and the fourth outer diameter coincides with the difference between the first outer diameter and the second outer diameter. In the illustrated example, the sizes in the X direction of the second large diameter section 651 and the second small diameter section 652 coincide with each other. The second taper section 653 is present in the same position as the first taper section 643 in the X direction. The second taper section 653 is formed in a truncated cone shape. The outer diameter of the second taper section 653 gradually increases toward the second large diameter section 651 side in the X direction. The second taper section 653 has an outer circumferential surface connected to the outer circumferential surfaces of the second large diameter section 651 and the second small diameter section 652. A forming range in the X direction of the second taper section 653 coincides with a forming range in the X direction of the first taper section 643.

The first taper section 643 and the second taper section 653 are formed such that parts facing each other are parallel. An inclination angle of the outer circumferential surface of the first taper section 643 with respect to the rotation axis of the first roller 64 coincides with an inclination angle of the outer circumferential surface of the second taper section 653 with respect to the rotation axis of the second roller 65. In this embodiment, the outer circumferential surfaces of the first roller 64 and the second roller 65 are formed in the same shape and the same size each other.

Figure 9:
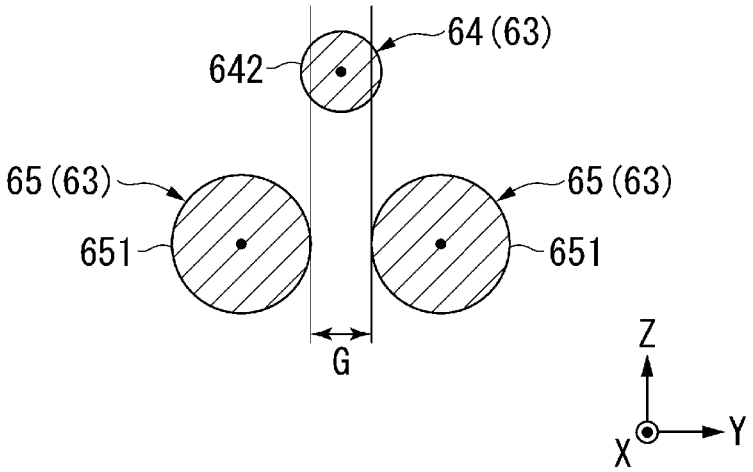
FIG. 9 is a diagram illustrating a YZ section in a third position of the first roller and the pair of second rollers.

FIG. 9 is a diagram illustrating a YZ section in the third position of the first roller and the pair of second rollers in the first embodiment. Note that the third position illustrated in FIG. 9 coincides with the second position B illustrated in FIG. 8. However, the third position illustrated in FIG. 9 is an example. As illustrated in FIG. 9, the outer diameter of the first roller 64 is larger than the interval between the pair of second rollers 65. Specifically, the outer diameter in the third position in the X direction of the first roller 64 is larger than an interval G in the third position in the X direction between the pair of second rollers 65. The third position is all positions in a range in the X direction from the end edge on the opposite side of the first small diameter section 642 in the first large diameter section 641 to the end edge on the opposite side of the first large diameter section 641 in the first small diameter section 642. Since the outer diameter of the first roller 64 is larger than the interval between the pair of second rollers 65, the first roller 64 is incapable of passing between the pair of second rollers 65 in the Y direction. Since the outer diameter of the first roller 64 is larger than the interval in the Y direction between the pair of second rollers 65 in all positions in the X direction, the outer diameter of the first large diameter section 641 is larger than the interval in the second position B between the pair of second rollers 65. That is, the outer diameter of the first large diameter section 641 is larger than the interval between a pair of second large diameter sections 651.

As illustrated in FIG. 8, the first roller 64 and the second roller 65 are relatively displaced in the Z direction and capable of approaching and separating from each other. In this embodiment, the first roller 64 is immovable in the Z direction. The first roller 64 and the second rollers 65 come into contact with each other via the first film 58 and the second film 59 to form a nip. The first roller 64 comes into contact with the sheets P from the +Z direction via the first film 58. The pair of second rollers 65 comes into contact with the sheep P from the −Z direction, which is the opposite side of the first roller 64, via the second film 59. The second large diameter section 651 holds the sheets P between the second large diameter section 651 and the first small diameter section 642. The second small diameter section 652 holds the sheets P between the second small diameter section 652 and the first large diameter section 641. The second taper section 653 holds the sheets P between the second taper section 653 and the first taper section 643. The pair of second rollers 65 equally presses the first roller 64 via the sheets P. The first roller 64 and the second rollers 65 hold the fold F of the sheets P therebetween and move in the Y direction. The first roller 64 and the second roller 65 roll on the sheets P to push and reinforce the fold F.

As illustrated in FIG. 4, the driving section 70 is present in the −Z direction of the additional folding unit 45. The driving section 70 includes a driving belt 72 and a motor 71.

The driving belt 72 is stretched around between a pair of pulleys separated in the Y direction. A rotation axis of the pair of pulleys is parallel to the X axis. A part of the driving belt 72 is connected to the roller unit 60. The motor 71 turns the driving belt 72 via the pulleys. Consequently, the roller unit 60 moves in the Y direction.

As illustrated in FIG. 3, if the saddle folding mechanism 30 is operating, the blade 43 pushes the center in the Z direction of the sheets P into between the pair of folding rollers 44. The fold F of the sheets P is formed on the end side in the +X direction of the saddle-folded sheets P. The pair of folding rollers 44 moves the sheets P in the +X direction. As illustrated in FIG. 5, the movement of the sheets P stops if the fold F of the sheets P reaches between the first film 58 and the second film 59 of the additional folding unit 45.

The additional folding unit 45 in this embodiment additionally folds the fold F of the sheets P as follows. The second control section 90 controls operations of the sections of the additional folding unit 45. The second control section 90 performs an additional folding operation explained below only if the number of the sheets P to be saddle-folded is equal to or larger than the predetermined number. However, the second control section 90 may perform the additional folding operation explained below regardless of the number of the sheets P to be saddle-folded.

The first supporting plate 56 and the first film 58 of the supporting section 55 move in the −Z direction. The sheets P are held between the first supporting plate 56, the first film 58 and the second supporting plate 57, the second film 59. The fold F of the sheets P is held between the first film 58 and the second film 59.

As illustrated in FIG. 4, the end portion in the −Y direction on the inner side of the frame 50 is a home position HP of the roller unit 60. If the saddle folding mechanism 30 is not operating, the roller unit 60 stays on standby in the home position HP. In the home position HP, the first roller 64 of the additional folding roller 63 illustrated in FIG. 5 is separated from the second roller 65 in the +Z direction.

If the sheets P enter the additional folding unit 45, the roller unit 60 moves in the +Y direction from the home position HP. According to the movement of the roller unit 60, the coil spring 68 pulls down the arm member 66 in the −Z direction. The first roller 64 supported by the arm member 66 moves in the −Z direction and approaches the second roller 65.

The first roller 64 comes into contact with the surface in the +Z direction of the first film 58. The second roller 65 comes into contact with the surface in the −Z direction of the second film 59. The first roller 64 and the second roller 65 hold the fold F of the sheets P via the first film 58 and the second film 59. The coil spring 68 illustrated in FIG. 5 urges the arm member 66 in the −Z direction. The first roller 64 supported by the arm member 66 presses the fold F of the sheets P via the first film 58. The additional folding roller 63 moves in the Y direction along the fold F. Consequently, the fold F of the sheets P is additionally folded. At the time of the additional folding operation by the additional folding unit 45 explained above, the sheets P are held by the pair of folding rollers 44.

Figure 10:
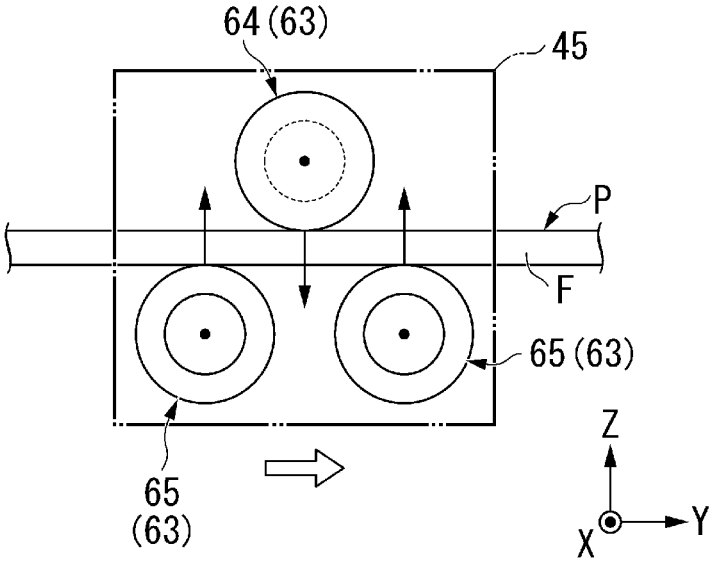
FIG. 10 is an operation explanatory diagram of the additional folding unit.

FIG. 10 is an operation explanatory diagram of the additional folding unit 45 in the first embodiment and is a side view illustrating the additional folding roller 63 that holds the sheets P. As illustrated in FIG. 10, at the time of the additional folding operation, the first roller 64 pushes the sheets P into between the pair of second rollers 65. The first roller 64 and the pair of second rollers 65 move in the Y direction in a state in which the sheets P are held between the first roller 64 and the pair of second rollers 65. If a bundle of the sheets P is relatively thin, the first roller 64 and the pair of second rollers 65 hold the sheets P such that the fold F of the sheets P extending in the Y direction if viewed from the +X direction bends. Note that FIG. 10 illustrates a state before the fold F of the sheets P held by the first roller 64 and the pair of second rollers 65 bends.

Figure 11:
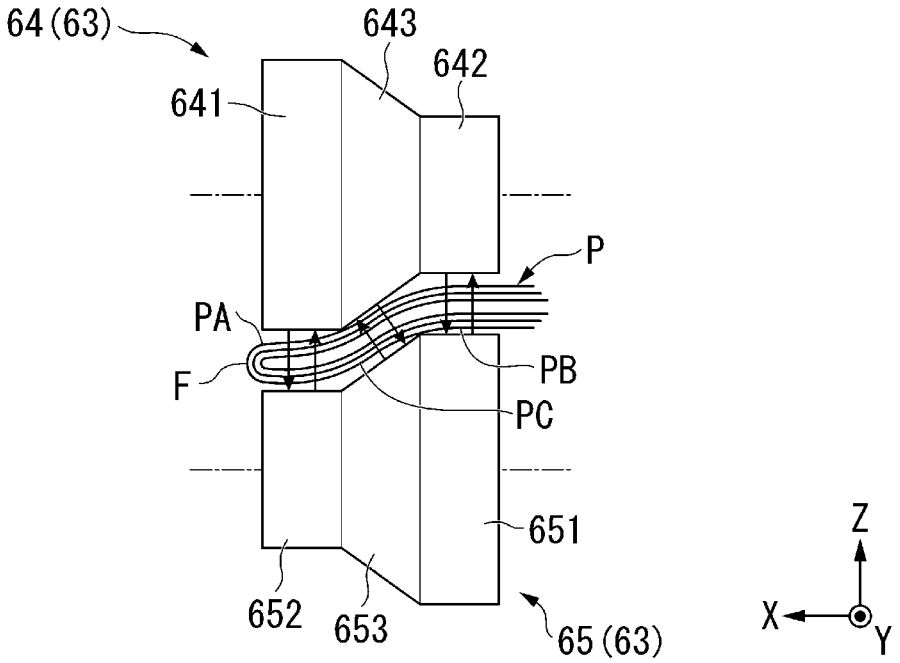
FIG. 11 is a front view illustrating a state in which the first roller and the second roller hold a sheet.

FIG. 11 is a front view illustrating a state in which the first roller 64 and the second roller 65 in the first embodiment hold the sheets P. As illustrated in FIG. 11, a portion of the sheets P held by the first roller 64 and the second roller 65 bends in a step shape if a position in a direction orthogonal to the X direction of the portion changes according to a position in the X direction of the portion. The portion of the sheets P held by the first roller 64 and the second roller 65 includes a first part PA, a second part PB, and a third part PC. The first part PA is held by the first large diameter section 641 and the second small diameter section 652. The second part PB is held by the first small diameter section 642 and the second large diameter section 651. The third part PC is held by the first taper section 643 and the second taper section 653. The first part PA is located closer to the fold F of the sheets P than the second part PB. The first part PA is located below the second part PB. The second part PB extends in parallel to the first part PA. The second part PB is present in a position shifted in the fold direction and the thickness direction of the sheets P orthogonal to the X direction with respect to the first part PA. The third part PC is located between the first part PA and the second part PB. The third part PC extends in a direction inclined with respect to the first part PA and the second part PB according to the shapes of the outer circumferential surfaces of the first taper section 643 and the second taper section 653. The sheets P bend in the thickness direction of the sheets P orthogonal to the fold direction by being held by the first roller 64 and the second roller 65 in a state in which the sheets P extend in the −X direction from the fold F. Force is applied to the first part PA and the second part PB in a direction orthogonal to the X direction, that is, in a direction in which the first roller 64 and the second roller 65 holding the sheets P are disposed side by side. Force is applied to the third part PC in a direction inclined closer to the X direction with respect to the direction in which the first roller 64 and the second roller 65 are disposed side by side.

The additional folding unit 45 in this embodiment includes the first roller 64 and the pair of second rollers 65 that holds the sheets P between the pair of second rollers 65 and the first roller 64. In this configuration, the first roller 64 can apply force along the fold F to the sheets P as illustrated in FIG. 10 and bend the sheets P near the fold F and reinforce the fold F by pushing the sheets P into between the pair of second rollers 65. However, the first roller 64 sometimes cannot sufficiently push a sheet bundle including the relatively large number of the sheets P into between the pair of second rollers 65. In this case, it is likely that the sheets P cannot be bent by the first roller 64 and the pair of second rollers 65 and sufficient force cannot be applied to the sheets P present on the inner side of the sheet bundle. As a result, it is likely that the fold F cannot be intensified.

In this embodiment, the additional folding unit 45 further includes the following components. The first roller 64 includes the first large diameter section 641 that is present in the first position A in the X direction and the first small diameter section 642 that is present in the second position B in the X direction and is smaller in diameter than the first large diameter section 641. Each of the pair of second rollers 65 includes the second large diameter section 651 that is present in the second position B in the X direction and holds the sheets P between the second large diameter section 651 and the first small diameter section 642 and the second small diameter section 652 that is present in the first position A in the X direction and holds the sheets P between the second small diameter section 652 and the first large diameter section 641. With this configuration, the first part PA of the sheets P held by the first large diameter section 641 and the second small diameter section 652 and the second part PB of the sheets P held by the first small diameter section 642 and the second large diameter section 651 shift in the thickness direction of the sheets P. Consequently, a part of the sheets P located between the first part PA and the second part PB bends. Force in the X direction, which is the conveying direction of the sheets P, orthogonal to the fold direction is also applied to the sheets P. Therefore, it is possible to securely intensify the fold F by applying not only the force along the fold F but also the force in the conveying direction of the sheets P to the sheets P.

The first roller 64 includes the first taper section 643 located between the first large diameter section 641 and the first small diameter section 642, the outer diameter of the first taper section 643 gradually decreasing toward the first small diameter section 642 side along the X direction. The second roller 65 includes the second taper section 653 located between the second large diameter section 651 and the second small diameter section 652, the outer diameter of the second taper section 653 gradually increasing toward the second large diameter section 651 side along the X direction. With this configuration, the sheets P are held by the first taper section 643 and the second taper section 653. The third part PC of the sheets P located between the first part PA and the second part PB extends along the outer circumferential surfaces of the first taper section 643 and the second taper section 653. Consequently, the sheets P are held by the first roller 64 and the second roller 65 in a bent state. Therefore, force in the X direction orthogonal to the fold direction can be securely applied to the third section PC. Therefore, it is possible to securely intensify the fold F.

Parts facing each other of the first taper section 643 and the second taper section 653 are parallel to each other. With this configuration, the third part PC of the sheets P can be equally held by the first roller 64 and the second roller 65. Therefore, force in the X direction orthogonal to the fold direction can be securely applied to the third part PC of the sheets P. Therefore, it is possible to securely intensify the fold F.

The first large diameter section 641 of the first roller 64 is present further in the +X direction than the first small diameter section 642. With this configuration, a part of the sheets P pushed into between the pair of second rollers 65 by the first large diameter section 641 is closer to the fold F than a part pushed into between the pair of second rollers 65 by the first small diameter section 642. Therefore, since the fold F of the sheets P is pushed into between the pair of second rollers 65 by the first large diameter section 641 at the time of the additional folding operation, the first toller 64 comes into contact with a wider range of the fold F compared with a configuration in which the fold F comes into contact with the first small diameter section 642. Therefore, force applied to the fold F from the first roller 64 can be dispersed to a wide range. It is possible to prevent the fold F from bending at a smaller curvature radius compared with the configuration in which the fold F comes into contact with the first small diameter section 642. Therefore, it is possible to prevent excessive force from being applied to the fold F at the time of the additional folding operation.

The pair of second rollers 65 is located below the first roller 64 and is immovable in the Z direction. With this configuration, it is possible to disable the second rollers 65 located below the sheets P to approach and separate from the moving path of the sheet P in the Z direction. Therefore, it is possible to cause the sheets P, which could sag with gravity, to stably enter between the first roller 64 and the second rollers 65.

The first roller 64 is displaceable in the Z direction. The first small diameter section 642 included in the first roller 64 is present further in the −X direction than the first large diameter section 641 included in the first roller 64. With this configuration, if the sheets P are pushed in the Z direction by the first roller 64 approaching the second rollers 65, a part of the sheets P pushed by the second large diameter section 651 is more greatly displaced in the Z direction than a part of the sheets P pushed by the first small diameter section 642. Since the part of the sheets P pushed by the second large diameter section 651 is near the fold F, which is the end portion of the sheets P on the downstream side in the conveying direction of the sheets P, it is possible to prevent a portion of the sheets P on the upstream side in the conveying direction away from the fold F from being pushed by the first roller 64 to be greatly displaced. Therefore, it is possible to prevent the sheets P from being pushed by the first roller 64 displaced in the Z direction and shifting at the time of the additional folding operation.

The outer diameter in the third position in the X direction of the first roller 64 is larger than the interval in the third position in the X direction between the second rollers 65. With this configuration, the first roller 64 is incapable of passing in the Y direction between the pair of second rollers 65. Therefore, it is possible to prevent the sheets P pushed into between the pair of second rollers 65 by the first roller 64 from biting in between the pair of second rollers 65 to cause damage such as creases and biting traces in the sheets P.

The outer diameter of the first large diameter section 641 is larger than the interval in the second position B between the pair of second rollers 65. With this configuration, it is possible to prevent the sheets P from being pulled by the first large diameter section 641 in the first position A and excessively biting in between the second rollers 65 in the second position B. Therefore, it is possible to prevent damage such as creases from occurring in the sheets P.

The rotation axis of the first roller 64 is present in the intermediate position C of the rotation axes of the pair of second rollers 65 in the X direction. With this configuration, the first roller 64 can equally apply force to the second rollers 65 side of the sheets P held by the first roller 64 and the pair of second rollers 65. Therefore, it is possible to prevent damage such as creases from occurring in the sheets P.

In this embodiment, the outer diameter of the first roller 64 is larger than the interval between the pair of second rollers 65 in all positions in the X direction but is not limited to this configuration. The outer diameter of the first roller 64 only has to be larger than the interval between the pair of second rollers 65 at least in one part in the X direction. That is, the third position may be any position in a range in the X direction from the end edge on the opposite side of the first small diameter section 642 in the first large diameter section 641 to the end edge on the opposite side of the first large diameter section 641 in the first small diameter section 642. Consequently, it is possible to disable the first roller 64 to pass in the Y direction between the pair of second rollers 65.

Second Embodiment

Figure 12:
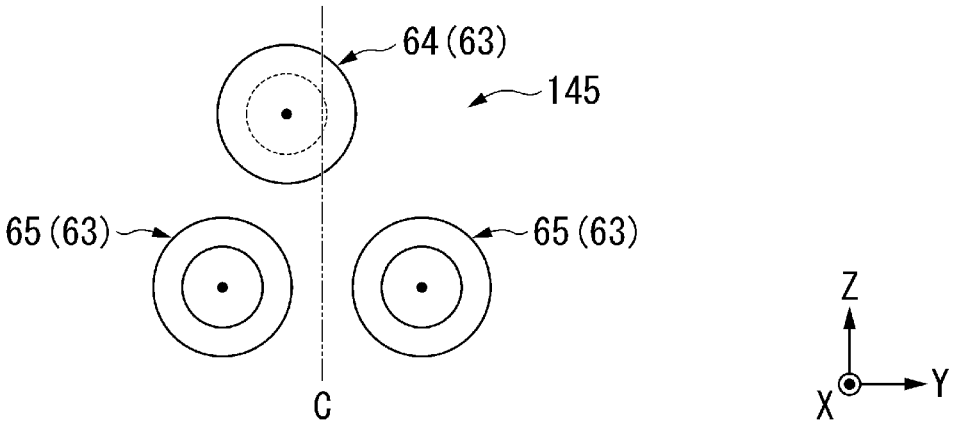
FIG. 12 is a side view illustrating the first roller and the pair of second rollers in a second embodiment.

A second embodiment is explained with reference to FIGS. 12 and 13. FIG. 12 is a side view illustrating the first roller 64 and the pair of second rollers 65 in the second embodiment. In the second embodiment illustrated in FIG. 12, the position of the first roller 64 with respect to the pair of second rollers 65 is different from the position in the first embodiment. Note that components other than those explained below are the same as the components in the first embodiment.

As illustrated in FIG. 12, the rotation axis of the first roller 64 is present between the rotation axes of the pair of second rollers 65 in the Y direction. The rotation axis of the first roller 64 is present in a position shifted in the Y direction with respect to the intermediate position C of the rotation axes of the pair of second rollers 65. The rotation axis of the first roller 64 is shifted in the −Y direction from the intermediate position C of the rotation axes of the pair of second rollers 65. In this embodiment, the −Y direction is closer to the home position HP.

Figure 13:
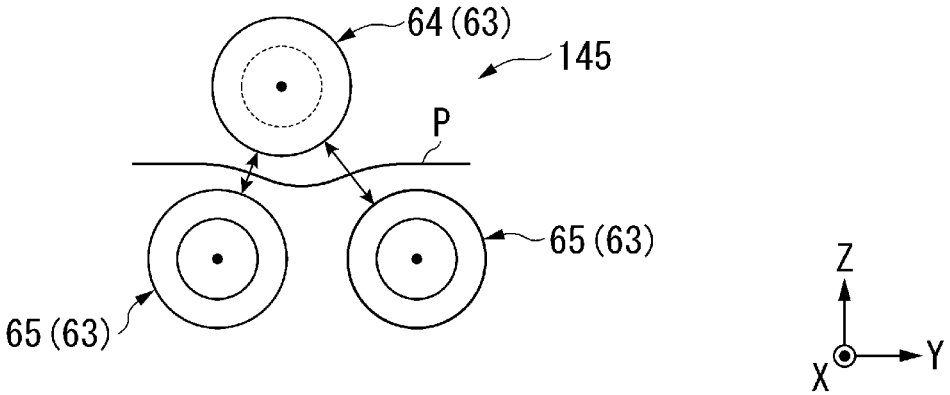
FIG. 13 is an operation explanatory diagram of an additional folding unit in the second embodiment.

FIG. 13 is an operation explanatory diagram of an additional folding unit 145 in the second embodiment. As illustrated in FIG. 13, at the time of an additional folding operation, the first roller 64 pushes the sheets P into between the pair of second rollers 65. The first roller 64 and the pair of second rollers 65 hold the sheets P such that the fold F of the sheets P extending in the Y direction if viewed from the +X direction bends. The first roller 64 pushes the sheets P in a direction inclined to the side of the rotation axes of the second rollers 65 with respect to the −Z direction. The second rollers 65 push the sheet P in a direction inclined to the side of the rotation axis of the first roller 64 with respect to the +Z direction. The first roller 64 and the pair of second rollers 65 move in the Y direction in a state in which the sheets P are held such that the fold F of the sheets P extending in the Y direction if viewed from the +X direction bends.

In this embodiment, the same effects as the effects in the first embodiment are achieved. In addition, in this embodiment, the first roller 64 is disposed closer to the −Y direction with respect to the intermediate position C of the pair of second rollers 65. Consequently, the interval between the first roller 64 and the second roller 65 in the +Y direction is wider than the interval between the first roller 64 and the second roller 65 in the −Y direction. Therefore, if the additional folding roller 63 moves in the +Y direction from the home position HP, the sheets P easily enter between the first roller 64 and the second rollers 65 from the +Y direction. Therefore, it is possible to realize a smooth additional folding operation by the additional folding unit 145.

Third Embodiment

Figure 14:
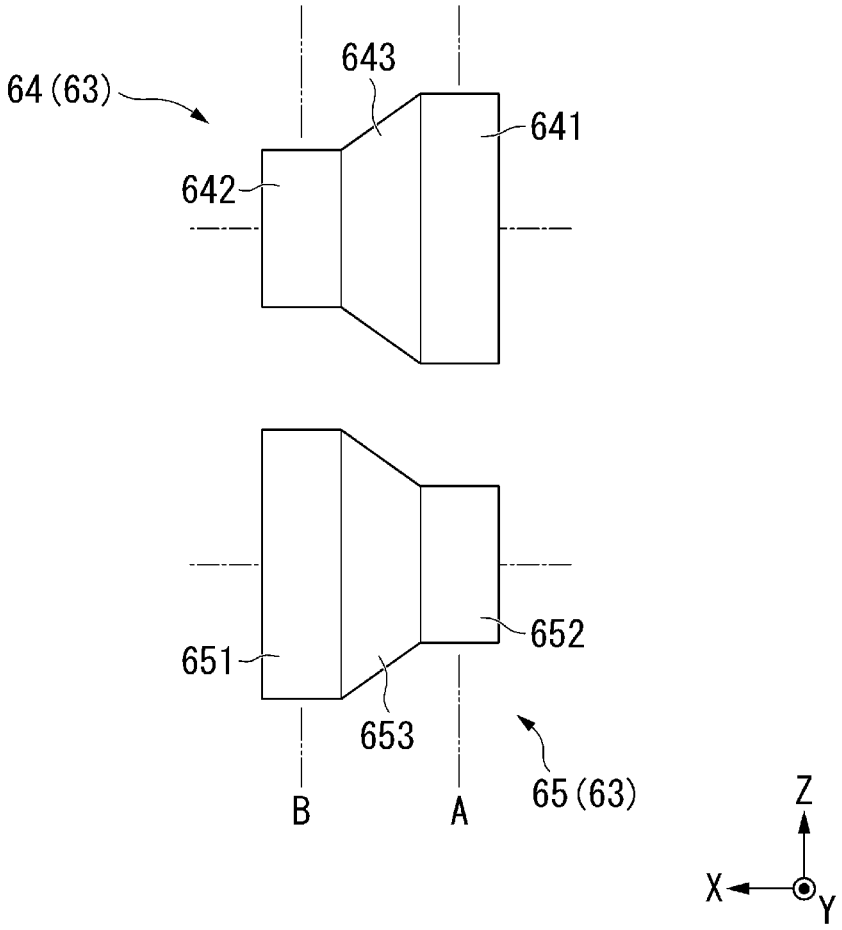
FIG. 14 is a front view illustrating the first roller and the second roller in a third embodiment.

A third embodiment is explained with reference to FIG. 14. FIG. 14 is a front view illustrating the first roller 64 and the second roller 65 in the third embodiment. In the third embodiment illustrated in FIG. 14, a positional relation between the first large diameter section 641 and the first small diameter section 642 in the first roller 64 and a positional relation between the second large diameter section 651 and the second small diameter section 652 in the second roller 65 are different from those in the first embodiment. Note that components other than those explained below are the same as the components in the first embodiment.

As illustrated in FIG. 14, the first roller 64 includes the first large diameter section 641 present in the first position A in the X direction, the first small diameter section 642 present in the second position B in the X direction, and the first taper section 643 located between the first large diameter section 641 and the first small diameter section 642. The second position B is a position different from the first position A and is present further in the +X direction than the first position A. Each of the second rollers 65 includes the second large diameter section 651 present in the second position B in the X direction, the second small diameter section 652 present in the first position A in the X direction, and the second taper section 653 located between the second large diameter section 651 and the second small diameter section 652. With this configuration, in this embodiment, the same effects as the effects in the first embodiment are achieved.

In the embodiments explained above, the additional folding roller 63 includes the taper sections but is not limited to this configuration. That is, an additional folding roller may not include taper sections and may have a configuration in which large diameter sections and small diameter sections are adjacent to each other.

In the embodiments explained above, the additional folding roller includes the large diameter sections and the small diameter sections extending at constant outer diameters but is not limited to this configuration. For example, the additional folding roller may be formed in a truncated cone shape in the entire length in the axial direction thereof and have different outer diameters in different two places in the axial direction.

In the embodiments explained above, the second roller 65 is un-displaceable in the Z direction. However, the second roller may be displaceable in the Z direction. The first roller may be un-displaceable in the Z direction and the pair of second rollers may be displaceable in the Z direction.

According to at least one embodiment explained above, the first roller 64 includes the first large diameter section 641 that is present in the first position A in the X direction and the first small diameter section 642 that is present in the second position B in the X direction and is smaller in diameter than the first large diameter section 641. Each of the pair of second rollers 65 includes the second large diameter section 651 that is present in the second position B in the X direction and holds the sheets P between the second large diameter section 651 and the first small diameter section 642 and the second small diameter section 652 that is present in the first position A in the X direction, holds the sheets P between the second small diameter section 652 and the first large diameter section 641, and is smaller in diameter than the second large diameter section 651. With this configuration, it is possible to apply not only force along the fold F but also force in the conveying direction of the sheets P to the sheet P and securely reinforce the fold F.

The several embodiments are explained above. However, these embodiments are present as examples and are not intended to limit the scope of the invention. These new embodiments can be implemented in other various forms. Various omissions, substitutions, and changes can be made without departing from the gist of the invention. The embodiments and modifications thereof are included in the scope and the gist of the invention and included in the scope of the inventions described in the claims and equivalents of the inventions.

The inventions described in the specification and the drawings of this application are noted below.

Note 1

A sheet processing device including:

a folding unit configured to fold a sheet and form a fold;

a first roller provided rotatably around an axis extending in a conveying direction orthogonal to a fold direction and configured to move in the fold direction; and a pair of second rollers provided rotatably around an axis extending in the conveying direction, configured to move in the fold direction while holding the sheet between the pair of second rollers and the first roller and additionally fold the fold, and disposed side by side in the fold direction, wherein the first roller includes a first large diameter section that is present in a first position in the conveying direction and a first small diameter section that is present in a second position in the conveying direction and is smaller in diameter than the first large diameter section, and each of the pair of second rollers includes a second large diameter section that is present in the second position and holds the sheet between the second large diameter section and the first small diameter section and a second small diameter section that is present in the first position, holds the sheet between the second small diameter section and the first large diameter section, and is smaller in diameter than the second large diameter section.

Note 2

The sheet processing device described in Note 1, wherein the first roller includes a first taper section located between the first large diameter section and the first small diameter section, an outer diameter of the first taper section gradually decreasing toward the first small diameter section side in the conveying direction, and each of the pair of second rollers includes a second taper section located between the second large diameter section and the second small diameter section, an outer diameter of the second taper section gradually increasing toward the second large diameter section side in the conveying direction.

Note 3

The sheet processing device described in Note 2, wherein parts facing each other of the first taper section and the second taper section are parallel to each other.

Note 4

The sheet processing device described in any one of Notes 1 to 3, wherein the first large diameter section is present further on a downstream side in the conveying direction than the first small diameter section.

Note 5

The sheet processing device described in any one of Notes 1 to 4, wherein at least one of the first roller and the pair of second rollers is located below the other and is immovable in a direction orthogonal to the conveying direction and the fold direction.

Note 6

The sheet processing device described in any one of Notes 1 to 5, wherein one of the first roller and the pair of second rollers is displaceable in a direction orthogonal to the conveying direction and the fold direction, and a small diameter section included in one of the first small diameter section and the second small diameter section is present further on an upstream side in the conveying direction than a large diameter section included in one of the first large diameter section and the second large diameter section.

What is claimed is:

1. A sheet processing device, comprising:

a folding component configured to fold a sheet and form a fold in the sheet;

a first roller that rotates around a first axis extending in a conveying direction orthogonal to a fold direction and configured to move in the fold direction; and a pair of second rollers that rotate around second axes extending in the conveying direction, configured to move in the fold direction while holding the sheet between the pair of second rollers and the first roller and additionally fold the fold, and disposed side by side in the fold direction, wherein the first roller includes a first large diameter section present in a first position in the conveying direction and a first small diameter section present in a second position in the conveying direction and is smaller in diameter than the first large diameter section, and each of the pair of second rollers includes a second large diameter section present in the second position and holds the sheet between the second large diameter section and the first small diameter section and a second small diameter section present in the first position, holds the sheet between the second small diameter section and the first large diameter section, and is smaller in diameter than the second large diameter section.

2. The sheet processing device according to claim 1, wherein an outer diameter in a third position in the conveying direction of the first roller is larger than an interval in the third position between the pair of second rollers.

3. The sheet processing device according to claim 1, wherein an outer diameter of the first large diameter section is larger than an interval in the second position between the pair of second rollers.

4. The sheet processing device according to claim 1, wherein the first axis of the first roller is present in an intermediate position of the second axes of the pair of second rollers in the fold direction.

5. The sheet processing device according to claim 1, wherein the first axis of the first roller is present in a position shifted in the fold direction with respect to an intermediate position of the second axes of the pair of second rollers in the fold direction.

6. The sheet processing device according to claim 1, wherein the first roller comprises the first large diameter section, the first small diameter section, and a first taper section located between the first large diameter section and the first small diameter section.

7. The sheet processing device according to claim 1, wherein each of the pair of second rollers comprises the second large diameter section, the second small diameter section, and a second taper section located between the second large diameter section and the second small diameter section.

8. The sheet processing device according to claim 1, wherein the first axis of the first roller is present between the second rotation axes of the pair of second rollers.

9. The sheet processing device according to claim 1, wherein each of the pair of second rollers has a same size and same shape.

10. The sheet processing device according to claim 1, wherein the first roller is configured to push the sheet into between the pair of second rollers.

11. An image forming apparatus, comprising:

an image forming section; and a sheet processing device, comprising:

a folding component configured to fold a sheet and form a fold in the sheet;

a first roller that rotates around a first axis extending in a conveying direction orthogonal to a fold direction and configured to move in the fold direction; and a pair of second rollers that rotate around a second axes extending in the conveying direction, configured to move in the fold direction while holding the sheet between the pair of second rollers and the first roller and additionally fold the fold, and disposed side by side in the fold direction, wherein the first roller includes a first large diameter section present in a first position in the conveying direction and a first small diameter section present in a second position in the conveying direction and is smaller in diameter than the first large diameter section, and each of the pair of second rollers includes a second large diameter section present in the second position and holds the sheet between the second large diameter section and the first small diameter section and a second small diameter section present in the first position, holds the sheet between the second small diameter section and the first large diameter section, and is smaller in diameter than the second large diameter section.

12. The image forming apparatus according to claim 11, wherein an outer diameter in a third position in the conveying direction of the first roller is larger than an interval in the third position between the pair of second rollers.

13. The image forming apparatus according to claim 11, wherein an outer diameter of the first large diameter section is larger than an interval in the second position between the pair of second rollers.

14. The image forming apparatus according to claim 11, wherein the first axis of the first roller is present in an intermediate position of the second axes of the pair of second rollers in the fold direction.

15. The image forming apparatus according to claim 11, wherein the first axis of the first roller is present in a position shifted in the fold direction with respect to an intermediate position of the second axes of the pair of second rollers in the fold direction.

16. The image forming apparatus according to claim 11, wherein the first roller comprises the first large diameter section, the first small diameter section, and a first taper section located between the first large diameter section and the first small diameter section.

17. The image forming apparatus according to claim 11, wherein each of the pair of second rollers comprises the second large diameter section, the second small diameter section, and a second taper section located between the second large diameter section and the second small diameter section.

18. The image forming apparatus according to claim 11, wherein the first axis of the first roller is present between the second rotation axes of the pair of second rollers.

19. The image forming apparatus according to claim 11, wherein each of the pair of second rollers has a same size and same shape.

20. The image forming apparatus according to claim 11, wherein the first roller is configured to push the sheet into between the pair of second rollers.

* * * * *